United States Patent [19]

Brown

[11] 4,407,643

[45] Oct. 4, 1983

[54] POWER FLUID SYSTEM EMBODYING TWO-FLUID PUMP

[75] Inventor: Arthur K. Brown, South Bend, Ind.

[73] Assignee: The Bendix Corporation, Southfield, Mich.

[21] Appl. No.: 307,359

[22] Filed: Oct. 1, 1981

Related U.S. Application Data

[63] Continuation of Ser. No. 95,735, Nov. 19, 1979, abandoned.

[51] Int. Cl.[3] ..... F04B 17/04

[52] U.S. Cl. ..... 417/401; 60/545; 60/547.3; 60/548; 91/516; 137/625.65

[58] Field of Search ..... 91/516, 532, 533, 535, 91/459; 417/401, 392, 399; 60/413, 418, 421, 426, 545, 548, 547.3; 137/630.14, 630.15, 625.65

[56] References Cited

U.S. PATENT DOCUMENTS

| | | | |
|---|---|---|---|
| 1,039,539 | 9/1912 | Jaekel | 417/401 |
| 2,737,196 | 3/1956 | Eames | 91/516 |
| 2,955,539 | 10/1960 | Gardner | 417/401 |
| 2,988,890 | 6/1961 | Oishei et al. | 60/413 |
| 3,054,261 | 9/1962 | Marette et al. | 417/401 |
| 3,331,289 | 7/1967 | Horst | 91/459 |
| 3,467,021 | 9/1969 | Green, Jr. | 417/399 |
| 3,633,363 | 1/1972 | Larsen | 60/548 |
| 3,677,002 | 7/1972 | Fulmer | 60/545 |
| 3,688,498 | 9/1972 | Bach et al. | 60/548 |
| 3,724,332 | 4/1973 | Bach | 60/548 |
| 3,747,475 | 7/1973 | Runkle | 91/469 |
| 3,898,913 | 8/1975 | Hendrickson et al. | 91/433 |
| 4,128,112 | 12/1978 | Brown et al. | 60/548 |

*Primary Examiner*—Abraham Hershkovitz
*Assistant Examiner*—Richard L. Klein
*Attorney, Agent, or Firm*—Paul David Schoenle; Ken C. Decker

[57] ABSTRACT

A power fluid system for a vehicle embodying a two-fluid pump which utilizes an existing source of fluid under pressure is provided. The existing source of fluid enables a second source of fluid under pressure to be established through the two-fluid pump. Vehicles often require high pressure fluid to operate auxiliary equipment such as traction or anti-skid units, limited-slip differentials, and hydraulic load-leveling systems. More specifically, the two-fluid pump is a linear pump operated by fluid under pressure from the power steering pump of the vehicle. The two-fluid pump can supply a different fluid under higher pressure for the auxiliary equipment, as required. The pump is pulse cycled quickly to provide adequate quantities of both sources of fluids with the use of small capacity accumulators.

1 Claim, 3 Drawing Figures

POWER FLUID SYSTEM EMBODYING TWO-FLUID PUMP

This is a continuation, division, of application Ser. No. 95,735, filed Nov. 19,1979, now abandoned.

This invention relates to a power fluid system for a vehicle which system embodies a two-fluid linear pump.

More and more frequently, vehicles are requiring a source of high pressure fluid to operate auxiliary equipment or accessories such as traction and anti-skid units, limited-slip differentials, an hydraulic load-leveling systems. Heretofore, such pressurized fluid was supplied by a separately driven auxiliary pump or by an accumulator of sufficient capacity and charge pressure to supply the equipment.

The present invention relates to a power fluid system for vehicles embodying a two-fluid pump which utilizes pressurized fluid from an existing source of fluid, preferably the power steering pump, to establish a second source of fluid under pressure for the auxiliary equipment. The second fluid often is different from and not compatible with the first fluid, e.g. the second fluid being brake fluid and the first fluid being power steering fluid so that the two-fluid pump has provisions for maintaining the two fluids separate. The pump utilizes the pressurized power-steering fluid to pressurize the second fluid to a higher pressure than that of the power steering fluid, if required. The two-fluid pump is pulse cycled quickly to maintain sufficient capacity for the power steering gear while still providing sufficient capacity, usually with the aid of an accumulator, for the auxiliary equipment. The two-fluid pump also has provisions for supplying the power steering fluid from the power steering pump to the power steering gear at all times and for recirculating the fluid to the power steering pump directly.

It is, therefore, a principal object of the invention to provide a power fluid system for a vehicle, which system utilizes an existing source of fluid under pressure to establish a second source of fluid under pressure.

Another object of the invention is to provide a power fluid system for a vehicle which utilizes an existing source of fluid under pressure in the vehicle to establish a second source of fluid under pressure for auxiliary equipment, without requiring separate drive means.

A further object of the invention is to provide a two-fluid linear pump for establishing a second source of fluid under pressure with fluid from a first source which is already in existence.

Yet another object of the invention is to provide a two-fluid linear pump for a vehicle which produces a second source of fluid for auxiliary equipment utilizing fluid from a power steering pump.

Yet a further object of the invention is to provide a power fluid system for a vehicle for establishing a second source of fluid under pressure by means of a pulse cycled linear pump utilizing power steering fluid, which system requires smaller accumulators than heretofore.

Many other objects and advantages of the invention will be apparent from the following detailed description of a preferred embodiment thereof, reference being made to the accompanying drawings, in which.

Figure 1:
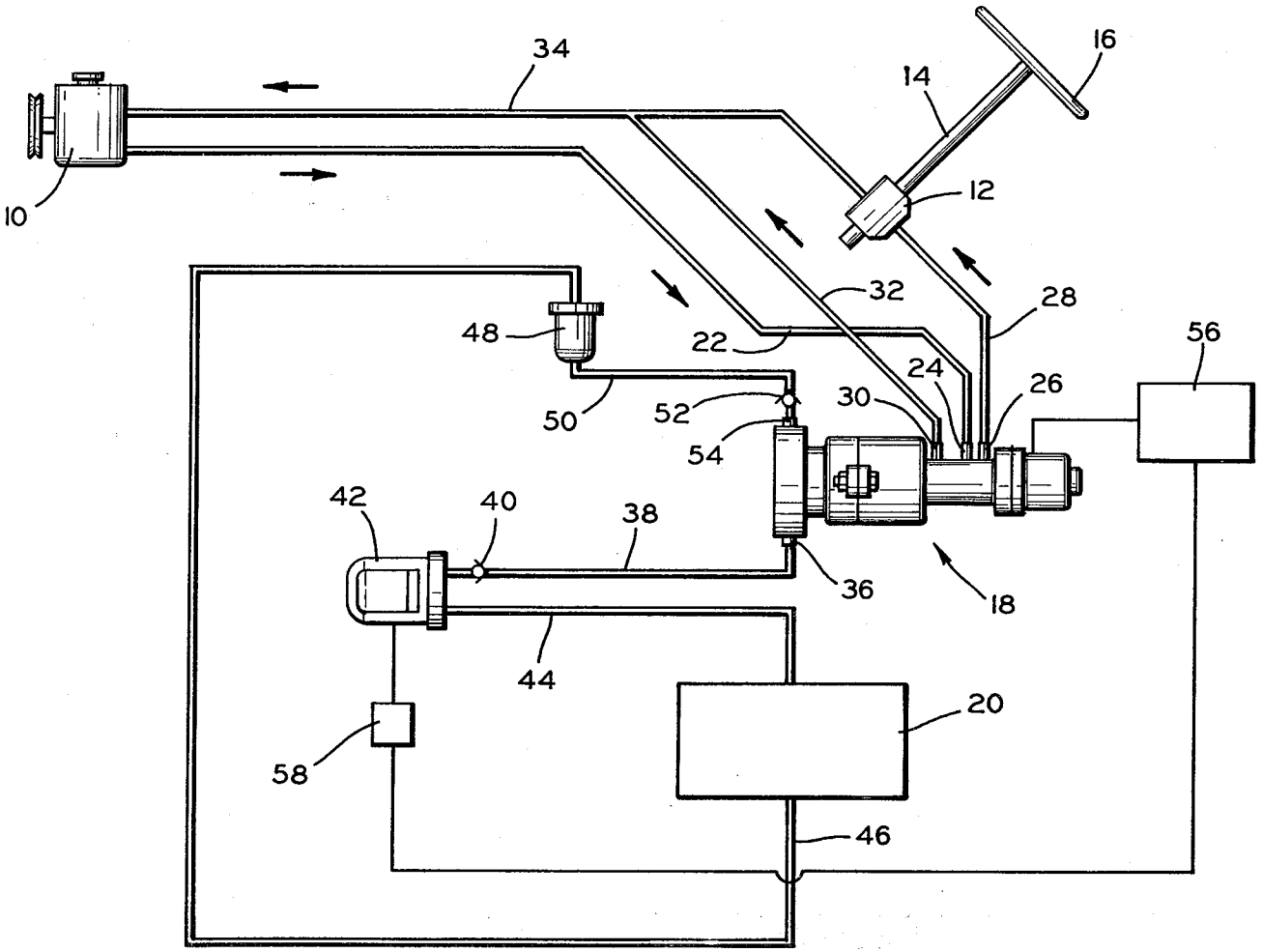
FIG. 1 is a schematic view of a power-fluid system embodying the invention.

Referring to the drawings, and particularly to FIG. 1, a power fluid system for a vehicle includes a conventional power steering power 10 and a power steering unit or gear 12 associated with a steering column 14 and a steering wheel 16 to aid in steering the vehicle. A two-fluid linear pump 18 utilizes power steering fluid pressure to establish a second source of fluid under pressure. The second fluid is used to operate auxiliary equipment or accessories indicated as 20. Such equipment can be traction or anti-skid units, limited-slip differentials, or hydraulic load-leveling systems, by way of example.

Power steering fluid from the pump 10 is supplied to the linear pump 18 through a line 22 to a pump inlet 24 and is supplied through a gear outlet 26 and a line 28 to the power steering gear 12. Power steering fluid is also returned through a return outlet 30, a line 32, and a return line 34 to the pump 10, bypassing the power steering gear 12.

Fluid, usually brake fluid under higher pressure than the power steering fluid, is supplied from a pump outlet 36 through a line 38 and a check valve 40 to an accumulator 42. The accumulator may not always be necessary in the system. From there, the fluid is supplied through a line 44 to the auxiliary equipment 20 and returned through a line 46 to a reservoir 48, a line 50, and a check valve 52 to a pump inlet 54 of the linear pump 18.

The pump 18 is pulse cycled through an electronic pulse control 56. A pressure regulator switch 58 communicates with the accumulator 42 and, if the pressure exceeds a predetermined value, the pulse cycling of the pump 18 is stopped.

Figure 2:
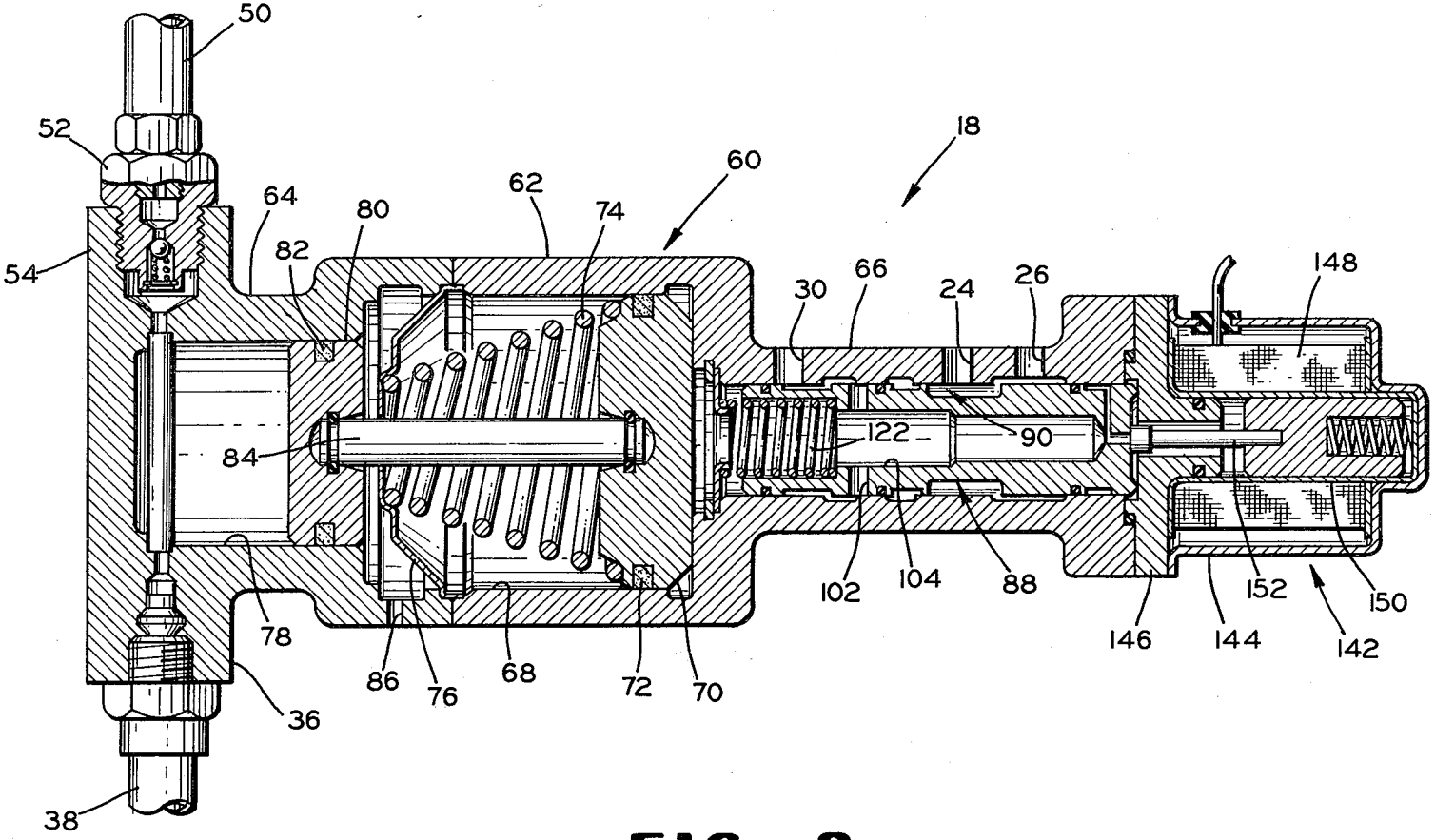
FIG. 2 is an enlarged, somewhat schematic view in longitudinal cross section of two-fluid, linear pump in accordance with the invention and embodied in the system of FIG. 1.
Figure 3:
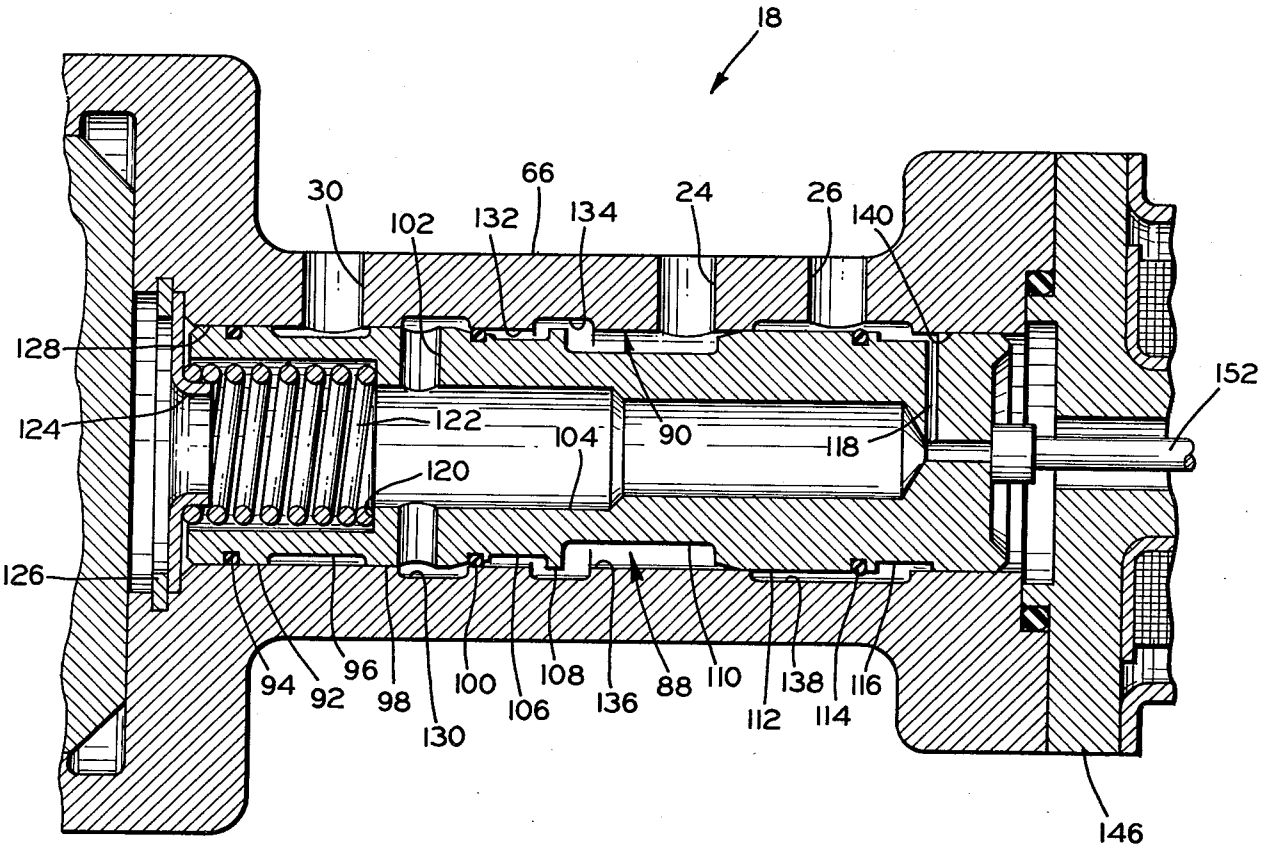
FIG. 3 is a further enlarged, somewhat schematic, fragmentary view in longitudinal section of a portion of the pump of FIG. 2.

Referring to FIGS. 2 and 3, the linear pump 18 includes a housing 60 having a large pump portion 62, a small pump portion 64, and a valve portion 66. The large pump portion 62 forms a cylinder 68 in which is a piston 70 having a piston ring 72. A return spring 74 seats against a face of the piston 70 and also against a spring seat 76. The small pump portion 64 also forms a cylinder 78 having a piston 80 with a ring 82, the pistons 70 and 80 being connected by a piston rod 84. A drain hole 86 is located between the cylinder 68 and the cylinder 78 to drain any fluid leaking past either of the pistons. Thus, the fluids, particularly if they are incompatible, will be removed from the housing 60 so as not to cause corrosion, etc.

In the operation of the pump pistons, when the power steering fluid is applied to the back of the piston 70, it moves forwardly in the cylinder 68 and moves the piston 80 forwardly in the cylinder 78. Fluid in the cylinder 78 is then forced by the piston 80 under pressure through the outlet 36 and the line 38. When the power steering fluid pressure is relieved, the return spring 74 moves the piston 70 back in the cylinder 68 and the piston 80 moves back in the cylinder 78. Fluid is then drawn through the inlet 54 past the check valve 52 from the line 50. The pressure of the fluid required for the auxiliary equipment 20 often exceeds that of the power steering fluid. For example, the power steering fluid can be at a pressure of 1200 psi, whereas the brake fluid for the auxiliary equipment may need to be in the order of 2400 psi. In that instance, the area of the piston 70 is twice that of the piston 80.

A valve spool 88 is located in a central passage 90 in the valve housing portion 66 and is movable between an at-rest position, as shown in FIG. 2, and an applied position, as shown in FIG. 3. Basically, when the valve spool 88 is in the at-rest position, power steering fluid is supplied through the line 22, (FIG. 1) to the line 28 via central passage 90 and the power steering gear 12. When the valve spool 88 is in the fully applied position, power steering fluid from the inlet 24 is supplied through the spool to the back of the piston 70 and a small amount is also supplied through the outlet 26 to the power steering gear 12, in order not to starve the power steering gear.

The valve spool 88 includes a cylindrical left end 92 (FIG. 3) having a sealing ring 94 and an adjacent annular groove 96. Next to that is an intermediate cylindrical portion 98 with a tapered edge adjacent a sealing ring 100. At least two transverse passages 102 are located in the cylindrical portion 98 and communicate with an internal bore or passage 104 in the spool 88. An annular groove 106 is located adjacent the sealing ring 100 with an annular ridge 108 next to that. Next is a wide annular groove 110 and a cylindrical right end 112 having a sealing ring 114. An annular groove 116 is located in the cylindrical end 112 and communicates with a transverse bypass passage 118 in the valve spool 88 communicating with the internal bore 104. The bore 104 has an annular shoulder 120 against which seats an end of a coil return spring 122. The other end of the return spring seats against a circular spring seat 124 held in the housing 60 by a split ring 126. The spring 122 urges the valve spool 88 toward the right, to the at-rest position, in the valve passage 90.

The valve passage 90 has a cylindrical left end surface 128 which communicates with the return outlet 30. Next to that is an annular groove 130, a circular ridge or land 132, and another annular groove 134. Next is a wide circular ridge or land 136, which communicates with the inlet 24, with an adjacent annular groove 138 communicating with the gear outlet 26. Finally, there is a cylindrical right end 140.

In the operation of the valve, when the valve spool 88 is in the at-rest, right end position, as shown in FIG. 2, the brake fluid is supplied from the inlet 24 directly to the outlet 26 to the power steering gear 12. Power steering fluid under pressure in the bore 104 also moves through the transverse openings 102 to the return outlet 30 via grooves 130 and 96, as the return spring 74 moves the piston 70 back to the right end of the cylinder 68 and the portion 98 forms a spacing with end 92 at groove 130.

When the valve spool 88 is moved to the applied or left end position in the passage 90, as shown in FIG. 3, fluid is supplied through the inlet 24 and the transverse openings 102 to the bore 104 as the seal 100 is moved to a position aligned with groove 130 and the ridge 108 forms a clearance with land 132. The spacing between the valve spool 88 and the spring rest 124 in FIG. 3 permits further movement of the valve spool 88 to its fully applied position. This fluid is applied to the back of the piston 70 and moves it forwardly in the cylinder 68 along with the piston 80 and the cylinder 78. At the same time, some of the power steering fluid from the bore 104 moves through the transverse passage 118, the annular groove 116, and the gear outlet 26 so that the power steering gear 12 will not be starved when the valve spool is in the applied position.

The valve spool 88 is pulse cycled between the at-rest and the applied positions. This can be accomplished through a solenoid 142 (FIG. 2) which can be energized for one second and de-energized for one second to provide the valve with thirty cycles per minute. The solenoid is located in a housing 144 mounted on a base plate 146 on the end of the housing 60. The solenoid includes a coil 148 with a core 150 having a core rod 152 engaging the end of the valve spool 88. The solenoid core is always surrounded by the power steering fluid even though the end of the core rod opposes the right end of bore 104. The core rod permits fluid communication from the bore 104 to the core 150 as there is no seal at the interface of the spool valve 88 and the rod 152.

When the coil 148 is energized, the core 150 moves toward the left and moves the valve spool from the at-rest position to the applied position. When the coil 148 is de-energized, the spool return spring 122 moves the spool 88 from the applied position to the at-rest position. The coil 148 is energized by the pulse control 56 of FIG. 1 which continues to operate until or unless the pressure in the fluid accumulator 42 exceeds a predetermined value, in which instance the sensing switch 58 shuts off the control 56.

From the above, it will be seen that the invention provides two sources of fluid under pressure for a vehicle using only one pump which is powered by the vehicle engine. Further, the system requires minimum use of accumulators, which can be of small size.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A pump comprising, in combination, a housing extending substantially linearly and defining a small diameter portion at one end thereof, a large diameter portion and valve portion, the small diameter portion including an inlet and an outlet for communicating a first fluid through said housing small diameter portion, a small diameter piston movably disposed within said housing small diameter portion and exposed to said first fluid, a large diameter piston movably disposed within said housing large diameter portion, a connecting rod secured to said large diameter piston and secured to said small diameter piston to move therewith, a valve member movably disposed within said housing valve portion, said housing valve portion including passage means to communicate a second fluid under pressure through said housing in communication with said valve member, and a solenoid assembly coupled to the other end of said housing, said housing defining a linearly extending stepped bore to movably receive said pistons and valve member, said solenoid assembly cooperating with said valve member in an energized state to move said valve member within said housing in order to communicate said second fluid under pressure with said large diameter piston via said stepped bore, said large diameter piston being movable from a rest position in response to the fluid pressure of the second fluid to move said small diameter piston from its rest position, said small diameter piston moving within said housing to develop fluid pressure for the first fluid, said pistons being biased to their rest positions by resilient means within said housing, said valve member defining a central passage communicating with said passage means when said valve member is moved by said solenoid assembly, said central passage cooperating with said linearly extending stepped bore to communicate second fluid pressure to said large diameter housing portion, said solenoid assembly including a rod engageable with said valve member to move the latter in the energized state and also cooperating with said valve member to close an end of said central passage, said solenoid assembly further including a base plate carried by the valve portion of said housing, said base plate substantially closing one end of said stepped bore and engaging said valve member to define the rest position for the latter, said base plate also forming an opening for receiving the rod, said valve member defining a bypass passage communicating said central passage with said passage means to always maintain flow of second fluid pressure through said housing, and resilient means cooperating with said valve member and said rod to bias the same to their rest positions.

* * * * *